US008834116B2

(12) United States Patent
Guemmer

(10) Patent No.: US 8,834,116 B2
(45) Date of Patent: Sep. 16, 2014

(54) FLUID FLOW MACHINE WITH PERIPHERAL ENERGIZATION NEAR THE SUCTION SIDE

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1179 days.

(21) Appl. No.: 12/576,012

(22) Filed: Oct. 8, 2009

(65) Prior Publication Data

US 2010/0098527 A1 Apr. 22, 2010

(30) Foreign Application Priority Data

Oct. 21, 2008 (DE) ..... 10 2008 052 409

(51) Int. Cl.
*F01D 5/08* (2006.01)
*F04D 27/02* (2006.01)
*F04D 29/68* (2006.01)

(52) U.S. Cl.
CPC ..... *F04D 27/0207* (2013.01); *F04D 29/681* (2013.01)
USPC ..... 416/93 R

(58) Field of Classification Search
USPC ..... 416/90 R, 92, 93 R, 94, 96 R, 97 R; 415/116, 117
See application file for complete search history.

(56) References Cited

U.S. PATENT DOCUMENTS 2,393,042 A 1/1946 Hagen
2,489,683 A 11/1949 Stalker
2,653,754 A 9/1953 McDonald
2,690,293 A 9/1954 Muhlberg
2,837,270 A 6/1958 Chapman
2,870,957 A 1/1959 Stalker
2,933,238 A 4/1960 Stalker
2,972,806 A * 2/1961 Turner et al. ..... 29/889.721
3,066,912 A 12/1962 Scheper, Jr.

(Continued)

FOREIGN PATENT DOCUMENTS

CH 204331 4/1939
CH 275562 5/1951

(Continued)

OTHER PUBLICATIONS

European Search Report dated Apr. 8, 2014 from counterpart App No. 09010688.1.

(Continued)

*Primary Examiner* — Edward Look
*Assistant Examiner* — Aaron R Eastman
(74) *Attorney, Agent, or Firm* — Timothy J. Klima; Shuttleworth & Ingersoll, PLC

(57) ABSTRACT

A fluid flow machine has a main flow path ("MFP") 2 with a blade row 5 therein, a blade end of a blade row being connected to the MFP confinement and a peripheral chamber 7 arranged near this blade end outside the MFP confinement. An outlet 6 is arranged near the fixed blade end near a blade suction side can issue fluid from peripheral chamber 7 onto the surface of the MFP confinement into the MFP. The fluid jet is oriented essentially tangentially to the contour of the MFP confinement when viewed in the meridional plane (x-r plane) and essentially parallel to the local tangent to the skeleton line of the nearest profile, when viewed in the plane established by circumferential direction u and meridional direction m.

26 Claims, 14 Drawing Sheets

(56) References Cited

U.S. PATENT DOCUMENTS

Figure 1:
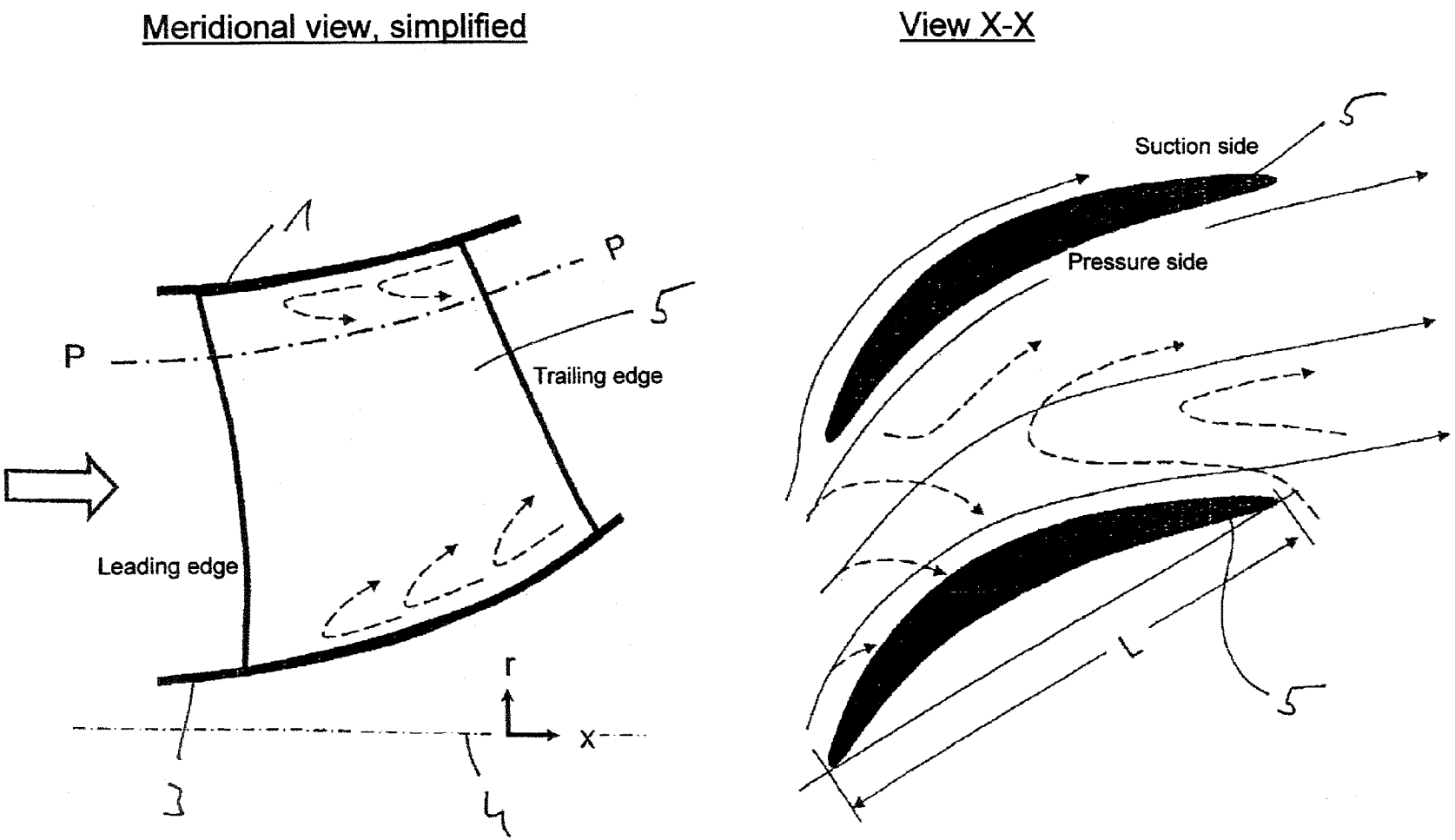
Fig. 1: (Prior Art)
Figure 2A:
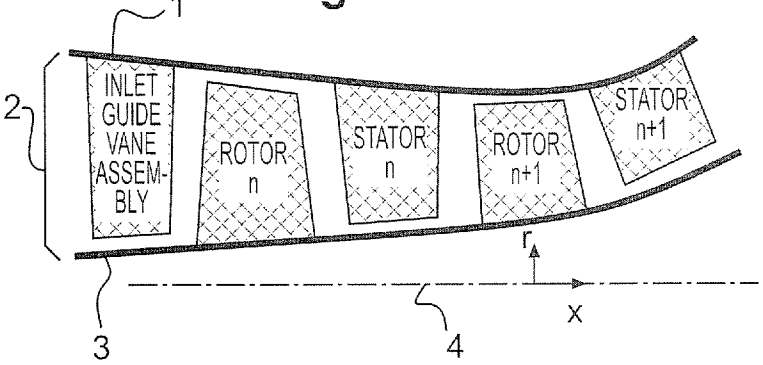
Figure 2B:
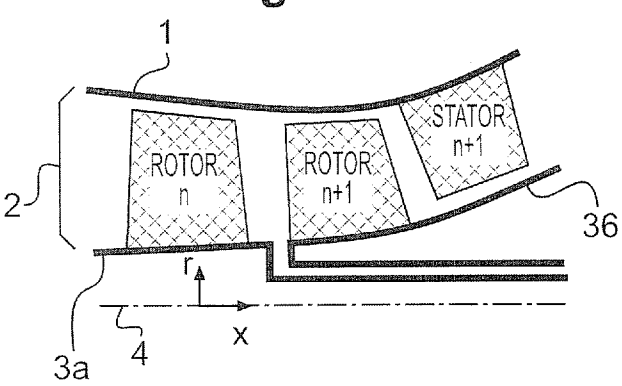
Figure 2C:
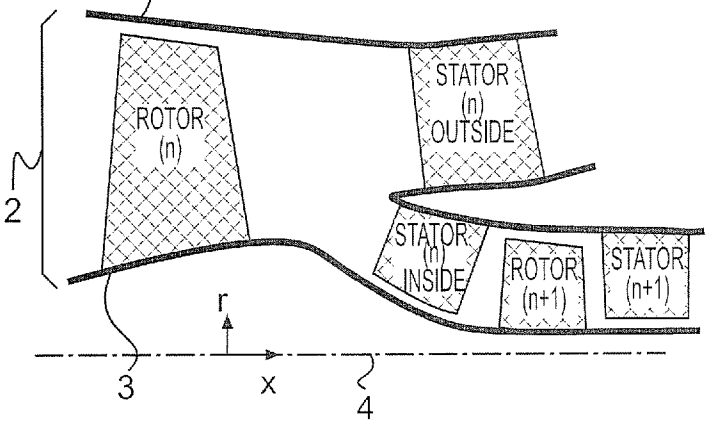
Figure 2D:
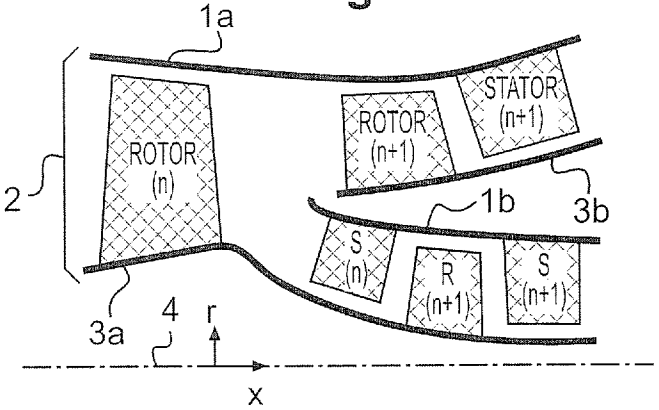

| | | | | |
|---|---|---|---|---|
| 3,201,856 | A * | 8/1965 | Keegan et al. | 29/889.721 |
| 3,572,960 | A | 3/1971 | McBride | |
| 3,694,102 | A | 9/1972 | Conrad | |
| 3,726,604 | A * | 4/1973 | Helms et al. | 415/115 |
| 3,846,038 | A | 11/1974 | Carriere et al. | |
| 3,993,414 | A | 11/1976 | Meauze et al. | |
| 4,146,352 | A | 3/1979 | Yasugahira et al. | |
| 4,155,680 | A | 5/1979 | Linko et al. | |
| 4,362,465 | A | 12/1982 | Riollet et al. | |
| 4,415,310 | A | 11/1983 | Bouiller et al. | |
| 4,642,027 | A | 2/1987 | Popp | |
| 4,883,404 | A | 11/1989 | Sherman | |
| 5,059,093 | A | 10/1991 | Khalid et al. | |
| 5,203,162 | A | 4/1993 | Burge | |
| 5,230,605 | A | 7/1993 | Yamaguchi et al. | |
| 5,327,716 | A | 7/1994 | Giffin et al. | |
| 5,419,681 | A * | 5/1995 | Lee | 416/97 R |
| 5,458,457 | A | 10/1995 | Goto et al. | |
| 5,472,314 | A | 12/1995 | Delonge et al. | |
| 5,480,284 | A | 1/1996 | Wadia et al. | |
| 5,690,473 | A | 11/1997 | Kercher | |
| 5,701,854 | A | 12/1997 | Hauser | |
| 5,762,034 | A | 6/1998 | Foss | |
| 5,876,182 | A | 3/1999 | Schulte | |
| 6,109,868 | A | 8/2000 | Burlman | |
| 6,125,626 | A | 10/2000 | El-Aini et al. | |
| 6,302,640 | B1 | 10/2001 | McKelvey | |
| 6,334,753 | B1 | 1/2002 | Tillman et al. | |
| 6,574,965 | B1 | 6/2003 | Feulner | |
| 6,585,479 | B2 | 7/2003 | Torrance | |
| 6,663,346 | B2 | 12/2003 | Munsell et al. | |
| 7,097,414 | B2 | 8/2006 | Stangeland | |
| 7,249,933 | B2 * | 7/2007 | Lee et al. | 416/97 R |
| 7,364,404 | B2 | 4/2008 | Guemmer | |
| 7,387,487 | B2 | 6/2008 | Guemmer | |
| 7,553,534 | B2 | 6/2009 | Bunker | |
| 7,600,966 | B2 * | 10/2009 | Devore et al. | 415/115 |
| 7,967,556 | B2 | 6/2011 | Guemmer | |
| 2002/0090295 | A1 * | 7/2002 | Torii et al. | 415/115 |
| 2003/0026695 | A1 | 2/2003 | Schmuecker | |
| 2004/0081552 | A1 | 4/2004 | Guemmer | |
| 2005/0019152 | A1 | 1/2005 | Seitz | |
| 2005/0076646 | A1 * | 4/2005 | Bolis et al. | 60/775 |
| 2005/0111965 | A1 * | 5/2005 | Lowe et al. | 415/116 |
| 2005/0141990 | A1 * | 6/2005 | Guemmer | 415/134 |
| 2005/0226717 | A1 | 10/2005 | Xu | |
| 2006/0099074 | A1 * | 5/2006 | Kopmels | 416/97 R |
| 2006/0104805 | A1 | 5/2006 | Gummer | |
| 2007/0160475 | A1 * | 7/2007 | Rogers et al. | 416/96 R |
| 2008/0298951 | A1 | 12/2008 | Brault et al. | |
| 2009/0003989 | A1 * | 1/2009 | Guemmer | 415/115 |

FOREIGN PATENT DOCUMENTS

| | | |
|---|---|---|
| DE | 1042828 | 11/1958 |
| DE | 976186 | 4/1963 |
| DE | 1428188 | 11/1968 |
| DE | 1964057 | 7/1970 |
| DE | 2352236 | 4/1975 |
| DE | 3407945 | 9/1985 |
| DE | 4438184 | 4/1996 |
| DE | 19632207 | 2/1998 |
| DE | 10135003 | 10/2002 |
| DE | 10233032 | 1/2004 |
| DE | 10330084 | 3/2004 |
| DE | 10355241 | 6/2005 |
| DE | 102004030597 | 1/2006 |
| DE | 102007038858 | 3/2008 |
| EP | 0497574 | 8/1992 |
| EP | 0606475 | 7/1994 |
| EP | 0633392 | 1/1995 |
| EP | 0718469 | 6/1996 |
| EP | 0719908 | 7/1996 |
| EP | 1013937 | 6/2000 |
| EP | 1286022 | 2/2003 |
| EP | 1536146 | 6/2005 |
| EP | 1609999 | 12/2005 |
| FR | 1263010 | 6/1961 |
| FR | 1454266 | 7/1966 |
| GB | 619722 | 3/1949 |
| GB | 799675 | 8/1958 |
| GB | 987625 | 3/1965 |
| GB | 2058222 | 4/1981 |

OTHER PUBLICATIONS

German Search Report dated Mar. 14, 2013 from counterpart application.

* cited by examiner

FLUID FLOW MACHINE WITH PERIPHERAL ENERGIZATION NEAR THE SUCTION SIDE

This application claims priority to German Patent Application No. 10 2008 052 409.3, filed Oct. 21, 2008, which application is incorporated by reference herein.

This invention relates to a fluid flow machine with peripheral energization near the suction side.

The aerodynamic loadability and the efficiency of fluid flow machines, such as blowers, compressors, pumps and fans, is limited by the growth and the separation of boundary layers on the blades and in particular on the hub and casing walls. To remedy this problem in the case of high aerodynamic loading and important boundary layer growth on the annulus duct side walls (hub or casing), the state of the art provides solutions only to a limited extent.

Concepts are however known for blade surfaces (suction and pressure side). Related alternative solutions provide for direct passage of fluid from the blade pressure side to the blade suction side. Besides, a concept exists for rotors according to which air is supplied to hub and casing via slots extending in the circumferential direction of the machine to influence the wall boundary layers there. Finally, concepts exist in which the rotors at the casing are blown at via individual nozzles to favorably influence the radial gap flow there. While the general idea of influencing the boundary layer by insufflating or supplying fluid is contained in the state of the art, no effective solutions exist for influencing the side-wall boundary layer flow in blade arrangements with fixed blade end, i.e. connections of blade end and main flow path confinement without gap.

The state of the art is documented, among others, in the following publications:

U.S. Pat. No. 5,690,473
U.S. Pat. No. 6,334,753
U.S. Pat. No. 2,870,957
U.S. Pat. No. 2,933,238
U.S. Pat. No. 5,480,284

The flow in the blade rows of aerodynamically highly loaded fluid flow machines is characterized by a very high degree of flow re-direction to be attained. The required re-direction of the fluid flow can be so extreme, either in parts of the blade height or along the entire blade height, that premature separation of the boundary layer flow in the peripheral area on the hub and/or casing walls will occur with a conventional design.

Conventional blade rows without additional design features for stabilizing the wall boundary layers, as shown in FIG. 1, are unsuitable due to the occurrence of extremely high pressure losses and the inability to attain the flow re-direction required, with both phenomena being caused by heavy secondary flows, boundary layer separation and reflow. In consequence, the fluid flow machine will have a generally bad performance as regards efficiency and the stability margin available.

Blade rows with a design according to the state of the art, see FIG. 1, have too small of an operating range and losses too high to attain the operating characteristics required for modern fluid flow machines, this being due to the high aerodynamic loading of the side wall boundary layers, i.e. the boundary layers existing on the main flow path confinement. The solutions so far proposed for fluid supply on the flow path confinement primarily serve to influence the gap leakage flow on the rotor blade tips.

The present invention relates to blades of fluid flow machines, such as blowers, compressors, pumps and fans of the axial, semi-axial and radial type using gaseous or liquid working medium. The fluid flow machine may include one or several stages, each stage having a rotor and a stator, in individual cases, the stage is formed by a rotor only. The rotor includes a number of blades, which are connected to the rotating shaft of the machine and impart energy to the working medium. The rotor may be designed with or without a shroud at the outward blade end. The stator includes a number of stationary vanes, which may either include a fixed or a free vane end on the hub and on the casing side. Rotor drum and blading are usually enclosed by a casing, in other cases (e.g. aircraft or ship propellers) no such casing exists. The machine may also include a stator, a so-called inlet guide vane assembly, upstream of the first rotor. Departing from the stationary fixation, at least one stator or inlet guide vane assembly may be rotatably borne, to change the angle of attack. Variation is accomplished for example via a spindle accessible from the outside of the annulus duct. In an alternative configuration, multi-stage types of said fluid flow machines may have two counter-rotating shafts, with the direction of rotation of the rotor blade rows alternating between stages. Here, no stators exist between subsequent rotors. Finally, the fluid flow machine may—alternatively—include a bypass configuration such that the single-flow annulus duct divides into two concentric annuli behind a certain blade row, with each of these annuli housing at least one further blade row. FIG. 2 shows examples of four possible configurations of fluid flow machines.

A broad aspect of the present invention is to provide a fluid flow machine of the type specified above which, while avoiding the disadvantages of the state of the art, is characterized by exerting a highly effective influence on the boundary layer in the blade tip area.

More particularly, the present invention accordingly relates to a fluid flow machine with a main flow path in which at least one row of blades is arranged, with at least one blade end of a blade row being firmly connected to the main flow path confinement and at least one fluid-supplied peripheral chamber being arranged in the area of this blade end outside of the main flow path confinement, with at least one outlet being provided in the area of said fixed blade end in the vicinity of at least one blade suction side through which fluid is issued from said at least one peripheral chamber essentially in the direction of the main flow onto the surface of the main flow path confinement.

According to the present invention, a blade for application in a fluid flow machine is provided which in the area of at least one of its ends at the main flow path confinement has a specially designed outlet for tangential jet generation in the vicinity of the blade suction side such that fluid is enabled to aerodynamically favorably issue from a chamber outside of the main flow path confinement onto the surface of the main flow path confinement.

Figure 3A:
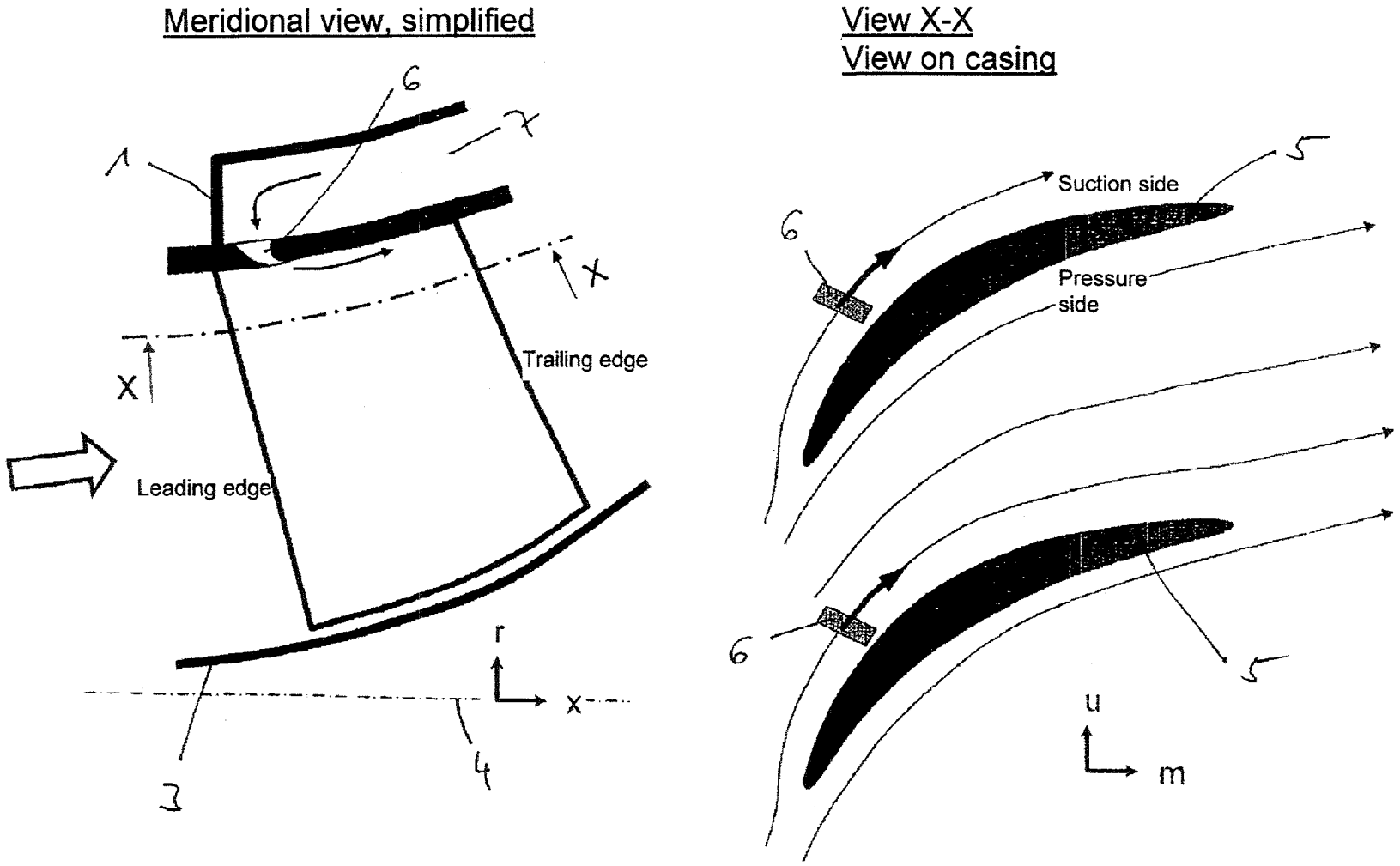
Figure 3B:
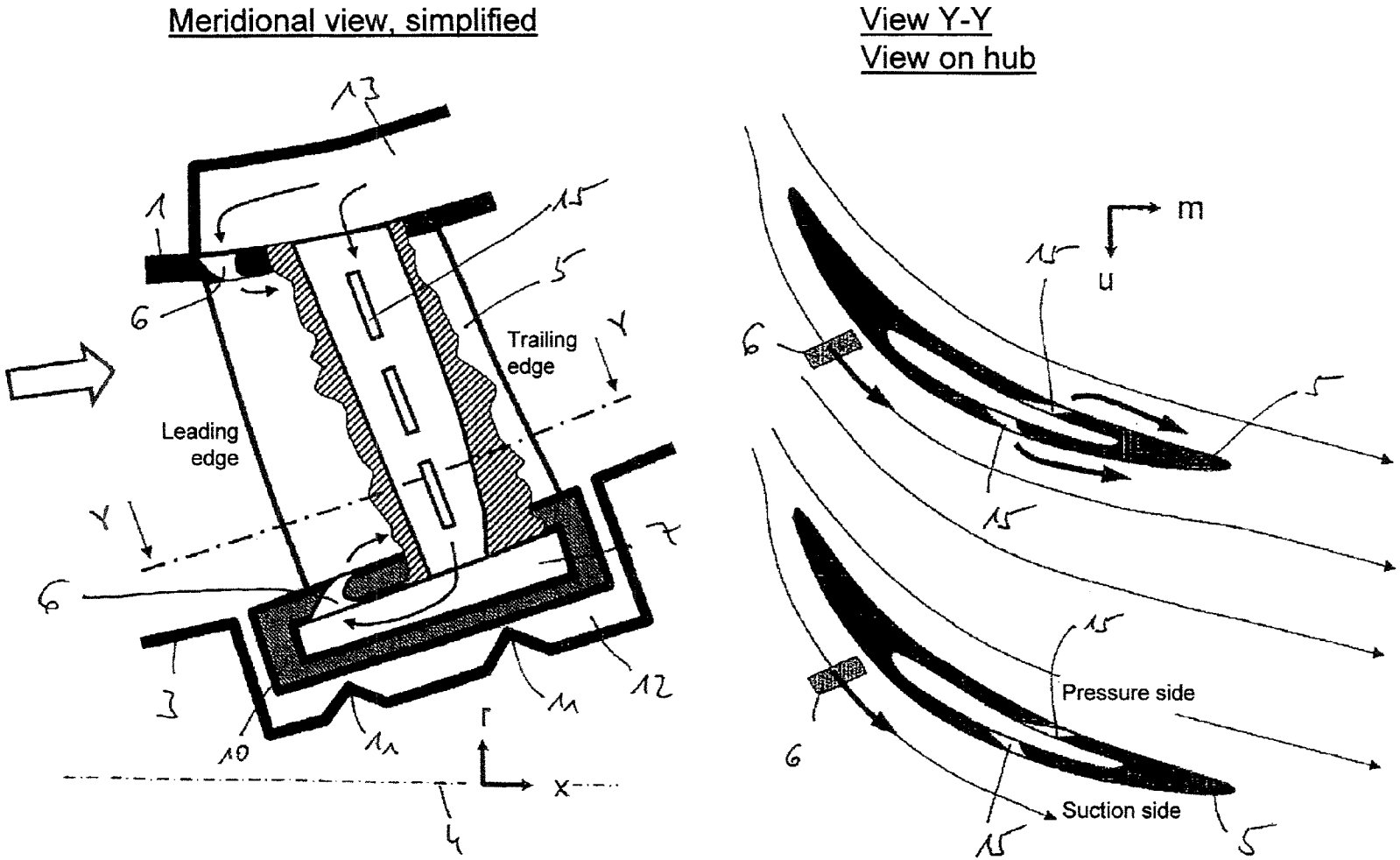
Figure 3C:
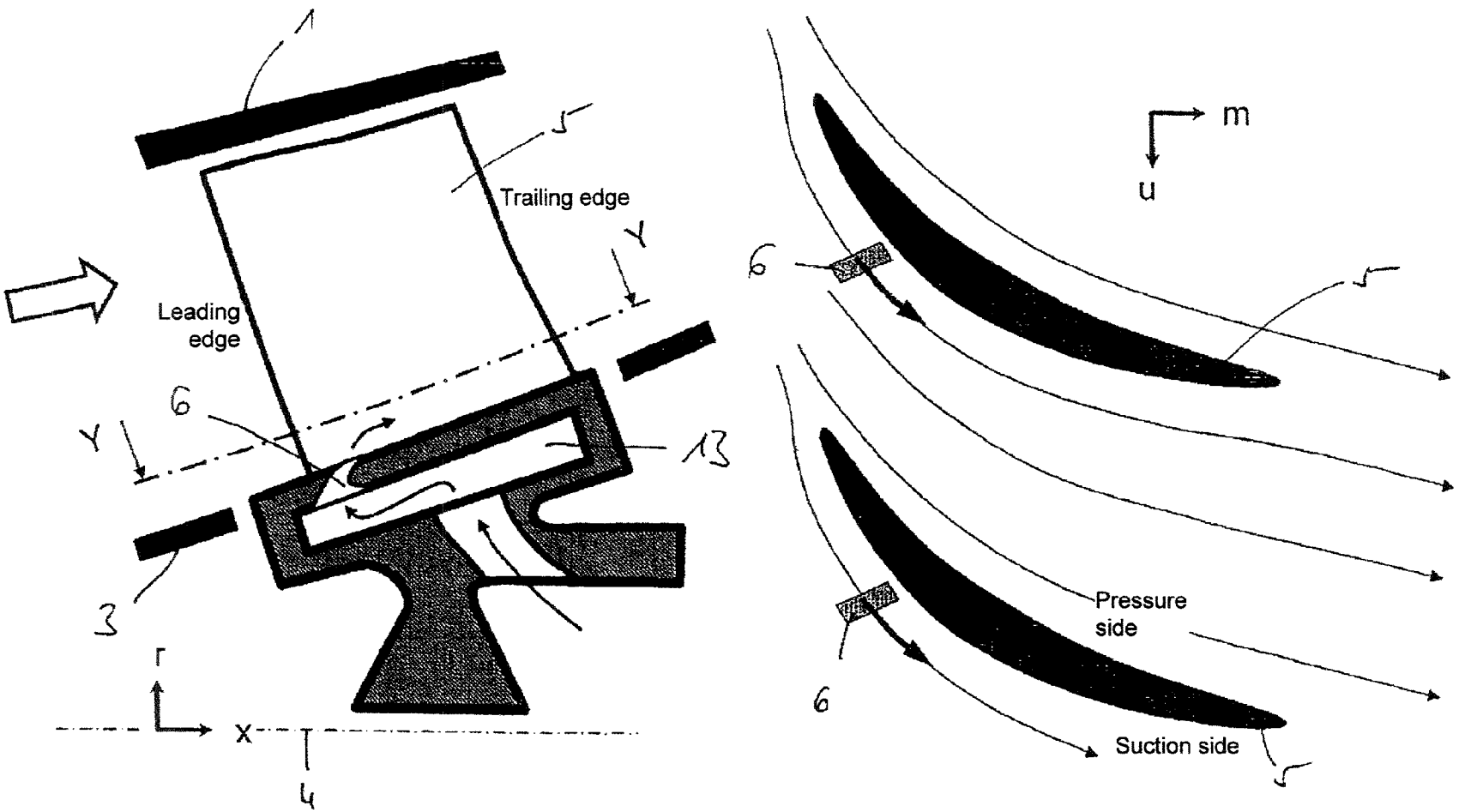
Figure 3D:
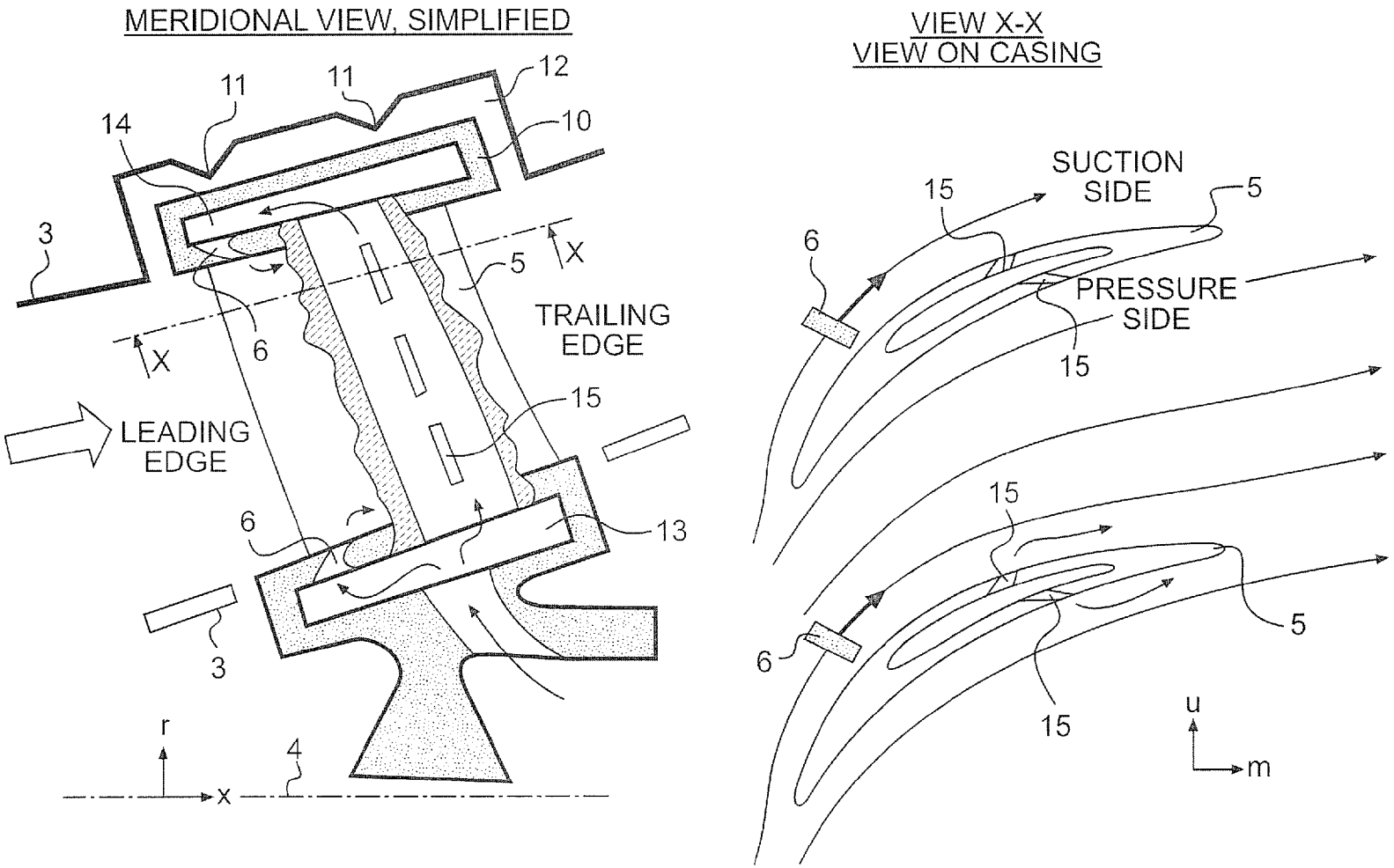
Figure 4A:
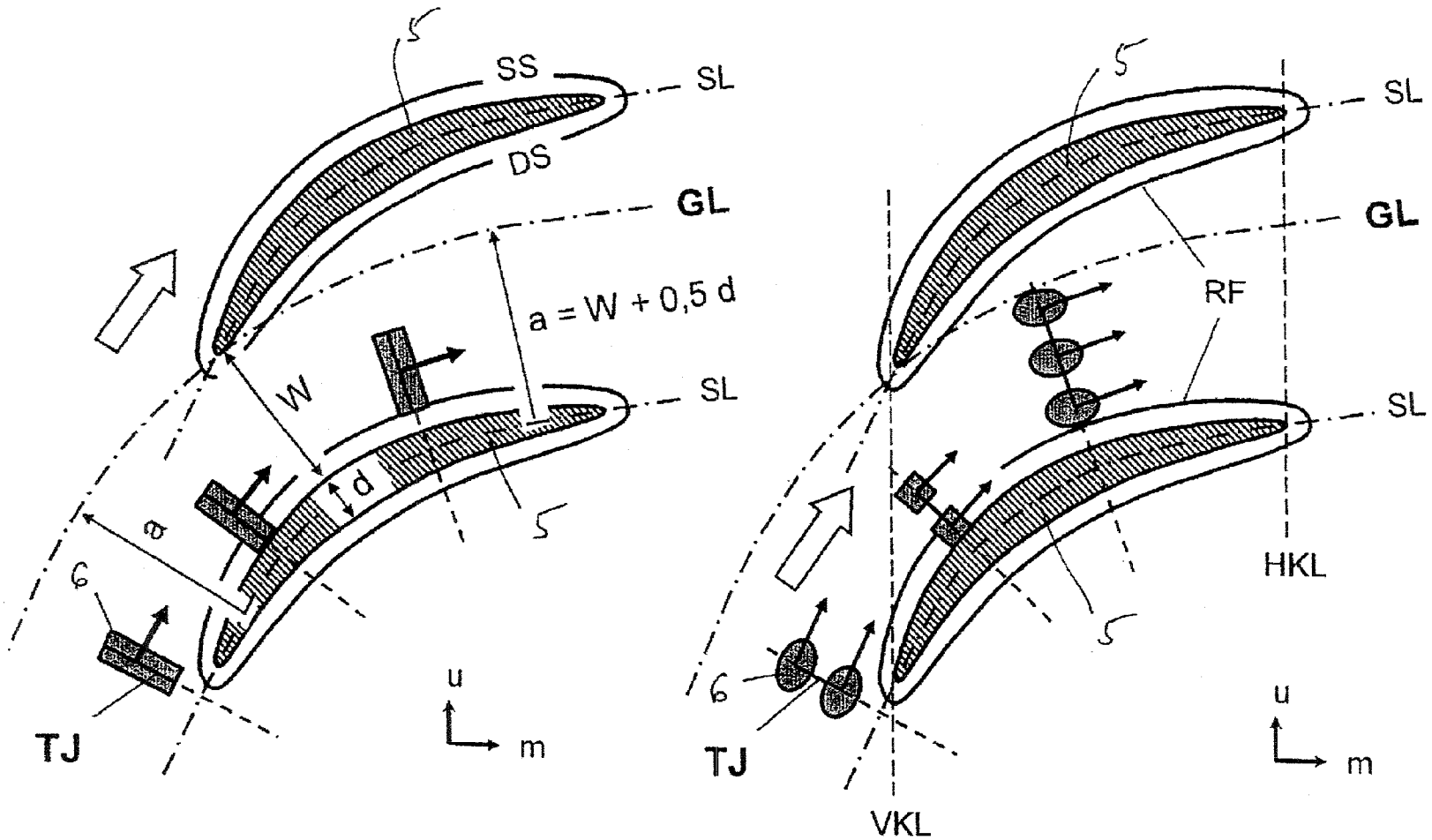
Figure 4B:
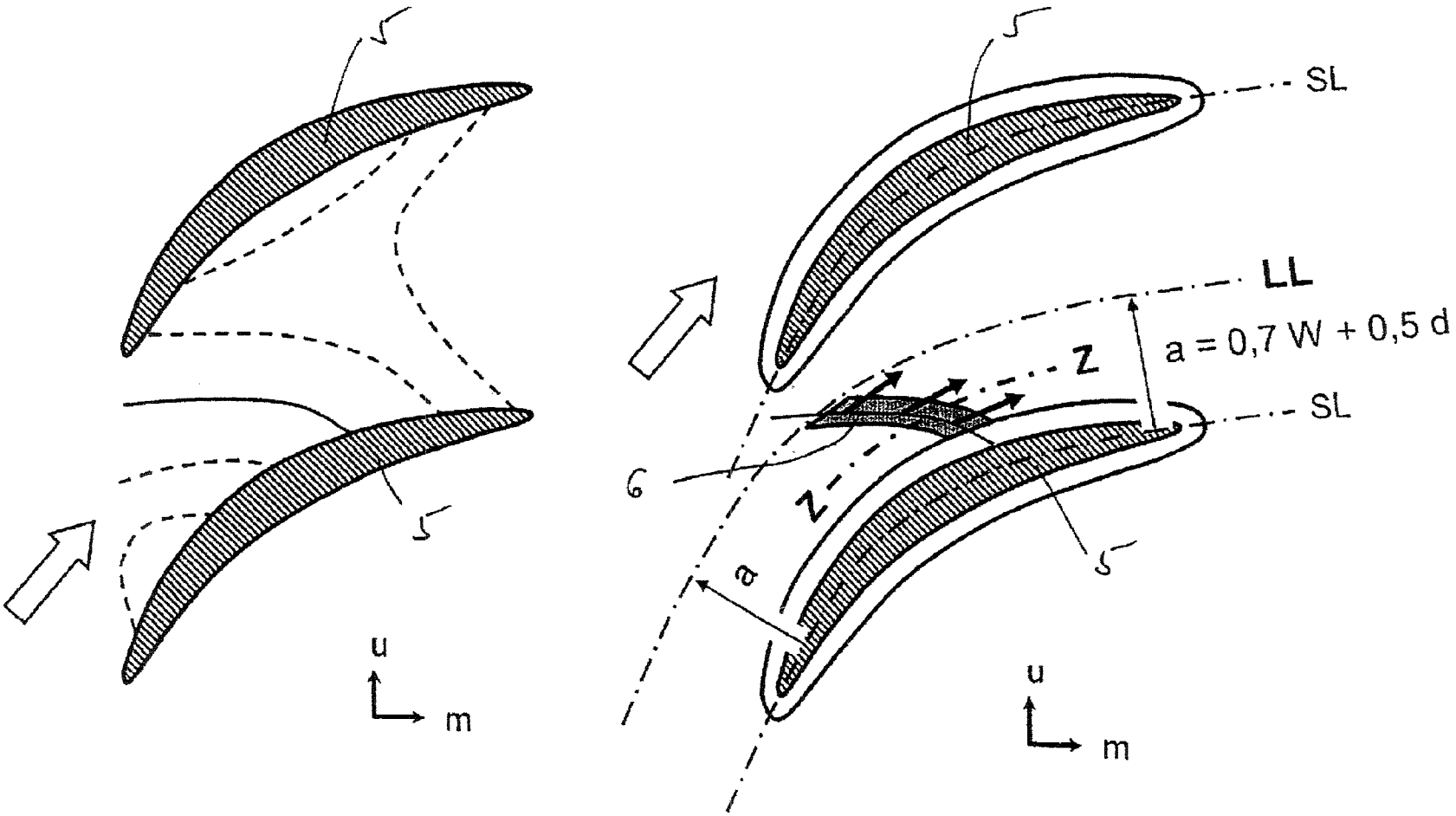
Figure 4C:
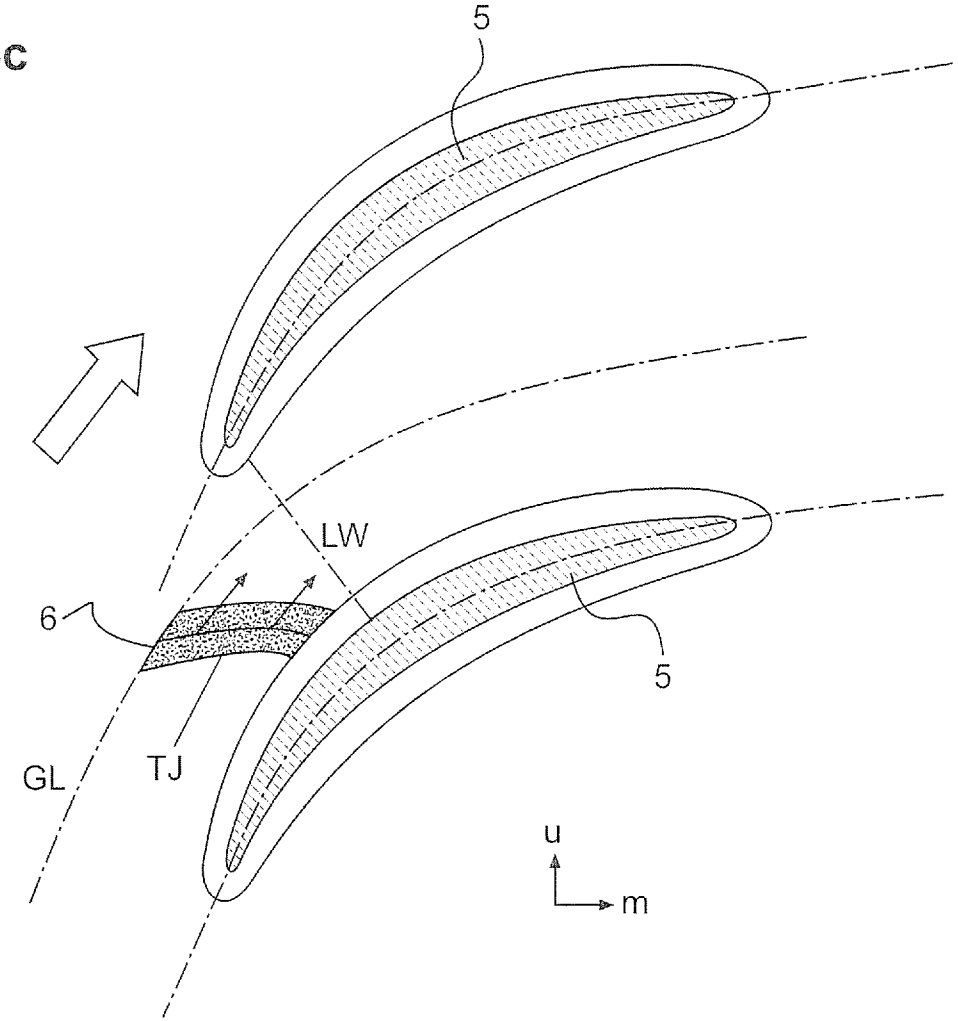
Figure 4D:
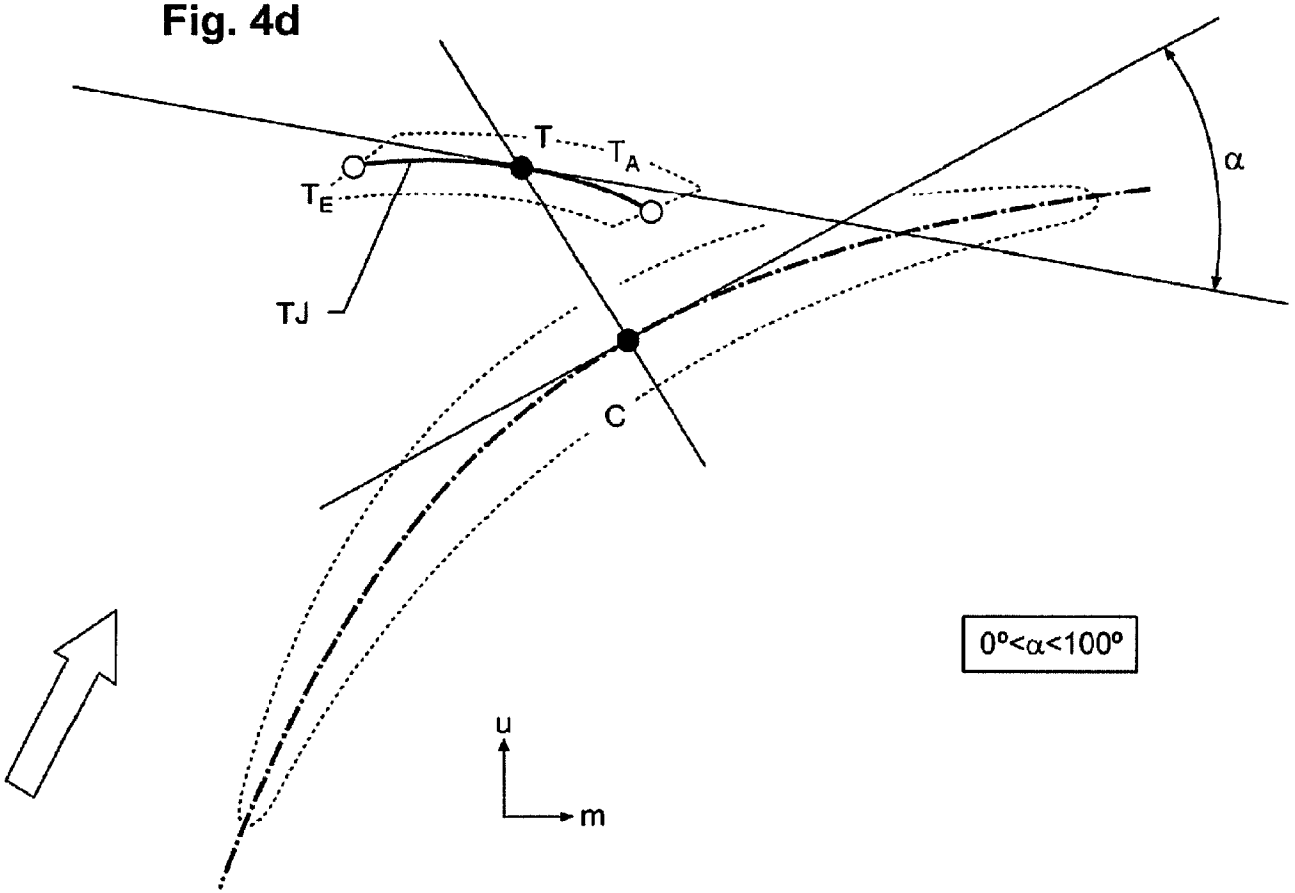
Figure 5A:
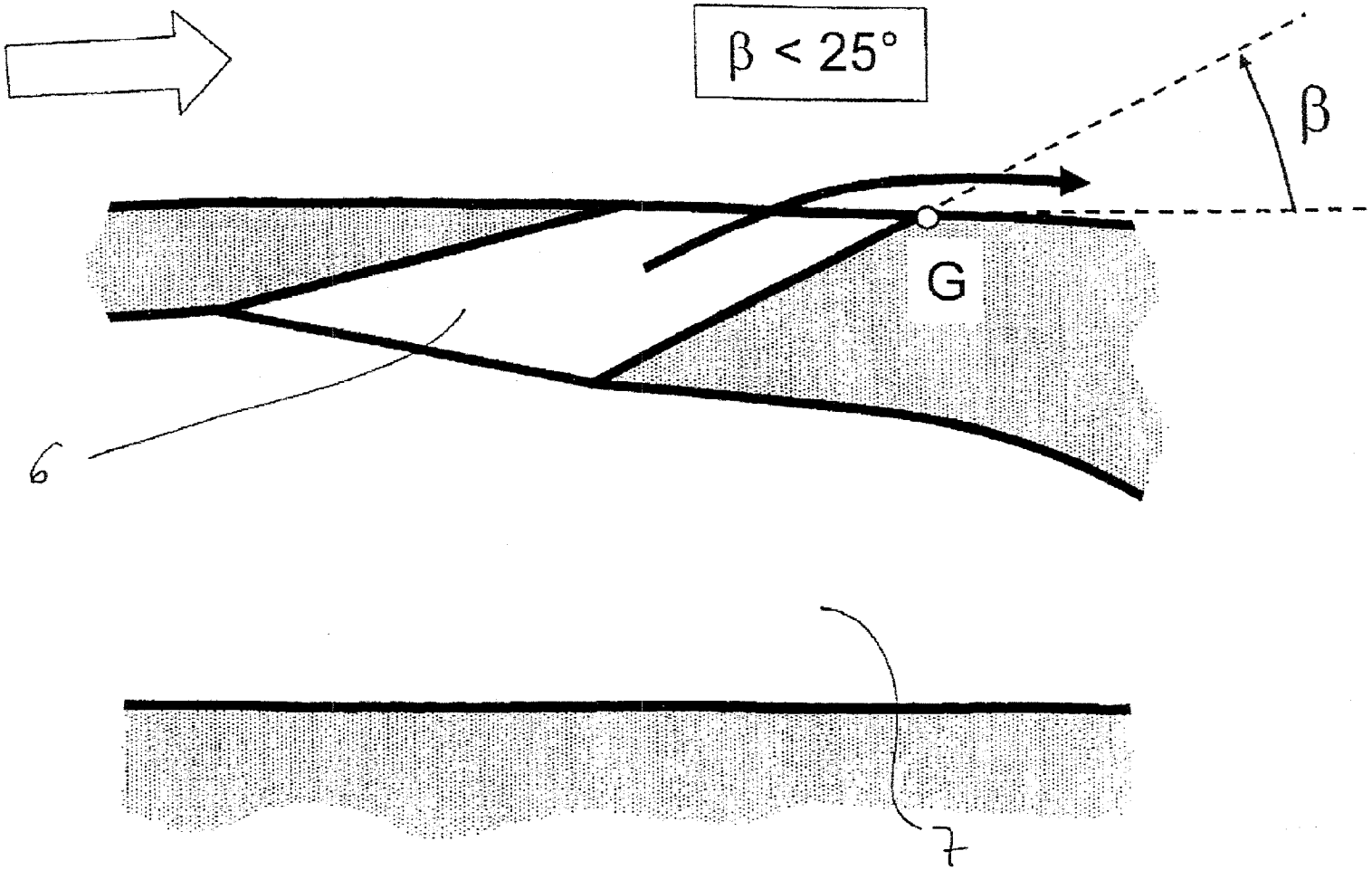
Figure 5B:
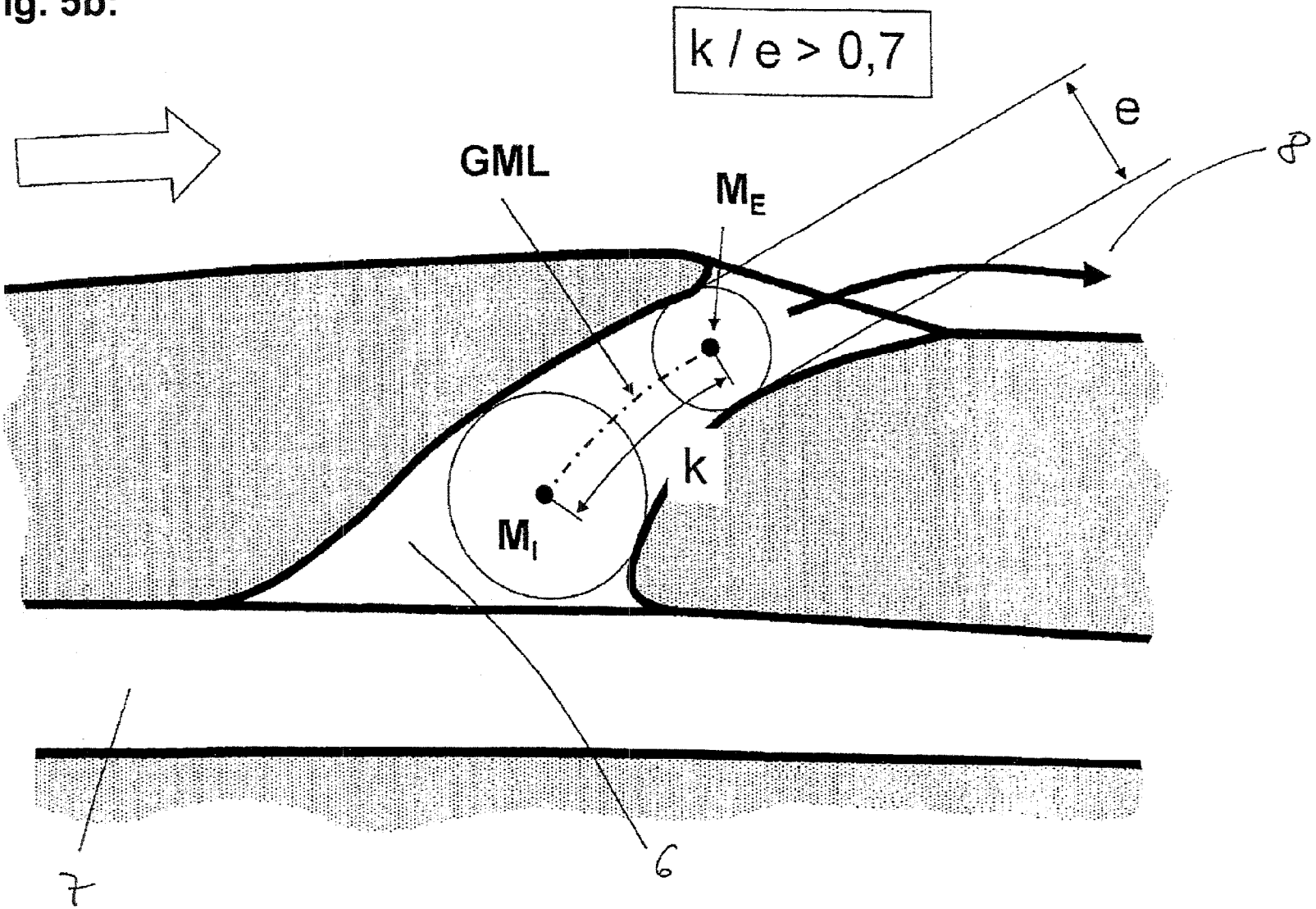
Figure 5C:
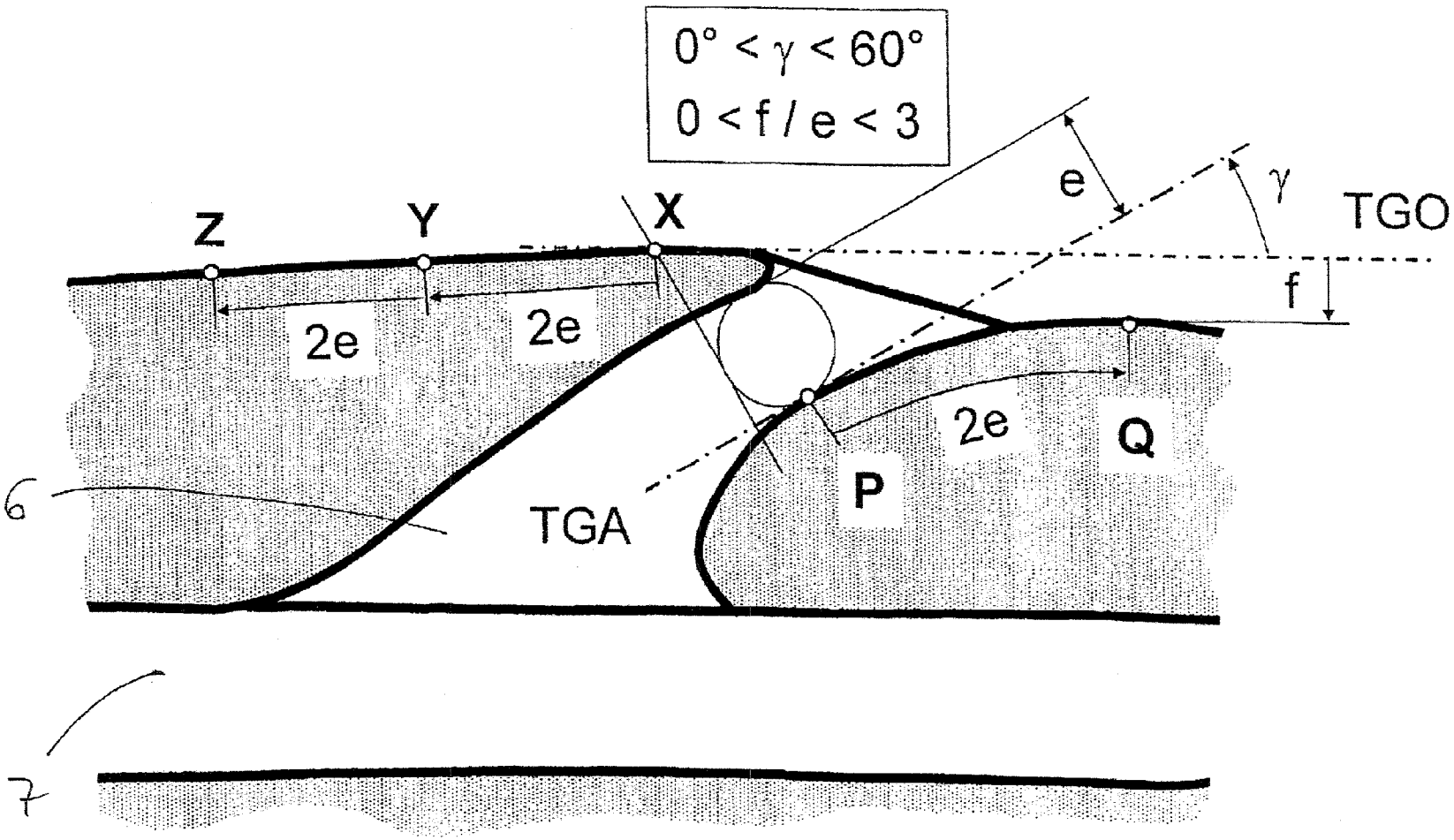
Figure 5D:
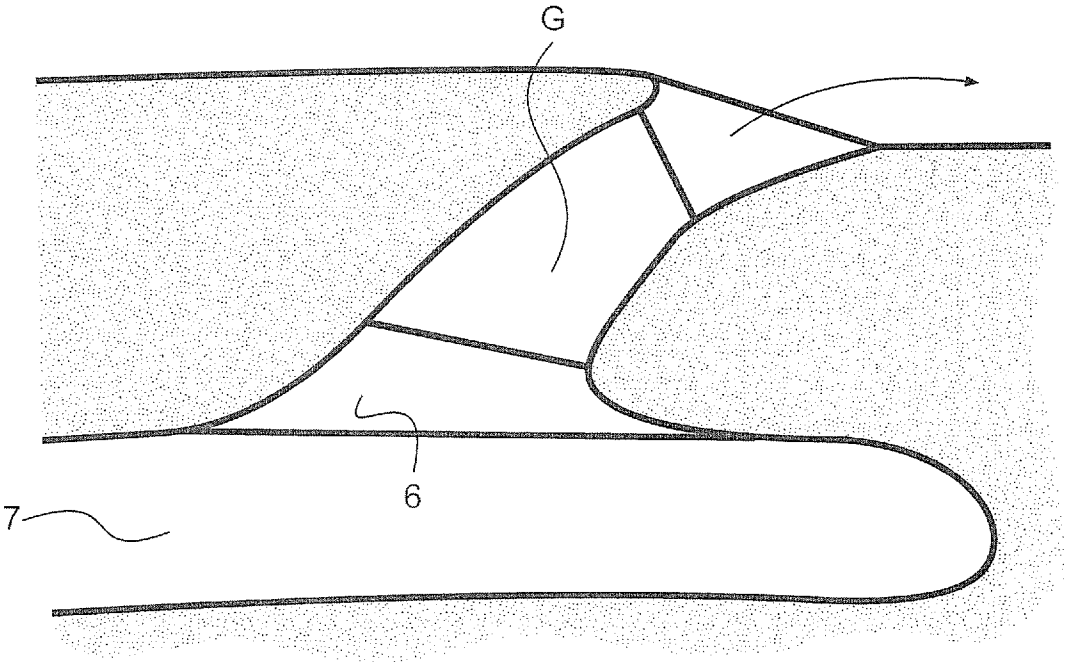

The present invention is more fully described in light of the accompanying figures showing preferred embodiments:

FIG. 1 shows a blade in accordance with the state of the art,

FIG. 2 shows possible configurations of fluid flow machines relevant to the present invention, FIG. 3*a* shows an example of a blade in accordance with the present invention, stator with free blade end at the hub, FIG. 3*b* shows an example of a blade in accordance with the present invention, stator with shroud at the hub, FIG. 3*c* shows an example of a blade in accordance with the present invention, rotor with free blade end at the casing, FIG. 3*d* shows an example of a blade in accordance with the present invention, rotor with shroud at the casing, FIG. 4*a* provides a side-wall jet generation in accordance with the present invention, view of annulus duct wall on a fixed blade end, orthogonal arrangement of exit trajectory, FIG. 4*b* provides a side-wall jet generation in accordance with the present invention, view of annulus duct wall on a fixed blade end, upstreamly inclined arrangement of exit trajectory, FIG. 4*c* provides a side-wall jet generation in accordance with the present invention, view of annulus duct wall on a fixed blade end, exit trajectory upstream of throat, FIG. 4*d* shows a definition of the trajectory inclination in accordance with the present invention, FIG. 5*a* shows a form of the outlet in accordance with the present invention, bend-type transition of the contour, section Z-Z, FIG. 5*b* shows a form of the outlet in accordance with the present invention, gradual transition of the contour, nozzle-type shape, section Z-Z, FIG. 5*c* shows a transition of the contour of the outlet to the surface in accordance with the present invention, section Z-Z, FIG. 5*d* shows an outlet with partition or deflection aid in accordance with the present invention, section Z-Z.

A conventional state-of-the-art blade row, as shown in FIG. 1, includes no outlets provided on the main flow path confinement near the suction side for the generation of a tangential jet. The right-hand side of FIG. 1 shows, in simplified form, a rotor blade or a stator vane row 5 in meridional section with the inflow passing from the left to the right (bold arrow).

While on conventional blades 5 the flow passes the individual profile sections of the blades 5 (see View X-X) from the leading edge (LE (VK)) to the trailing edge (TE (HK)) following the course of the blade passage, detrimental secondary flows occur at hub 3 or casing 1 near the flow path confinement, resulting in local reflow areas with partly detached flow (see broken arrows in the left and right-hand part of the figure).

FIG. 3*a* shows the example of a blade row according to the present invention, here a stator with fixed blade end at the casing 1 on which the mechanical loads occurring are transmitted to the physical structure of the fluid flow machine and which hereinafter is referred to as 'load-transmitting fixed blade end'. At the hub, a free blade end with running gap is provided.

The blade 5, being flown from the left to the right, is shown in meridional section in the left-hand part of the figure and in View X-X (casing view) in the right-hand part of the figure.

The stator has, at its load-transmitting fixed blade end, at least one fluid-supplied primary peripheral chamber disposed outside of the main flow path and outlined in the illustration in only simplified form, from which fluid issues onto the surface of the main flow path confinement through at least one outlet.

FIG. 3*b* shows the example of a blade 5 according to the present invention, here a stator with load-transmitting fixed blade end at the casing 1 and fixed blade end at the hub 3. Shroud 10 at hub 3 and rotor shaft perform a rotary movement relative to each other, with sealing being provided by sealing fins 11 in a cavity 12 surrounding the shroud 10. Such a fixed blade end is hereinafter referred to as "load-free fixed blade end".

The blade, being flown from the left to the right, is shown in meridional section in the left-hand part of the figure and in View Y-Y (hub view) in the right-hand part of the figure.

The stator has, at its load-transmitting fixed blade end, at least one fluid-supplied primary peripheral chamber 13 disposed outside of the main flow path 2, from which fluid issues onto the surface of the main flow path confinement through one outlet 6.

Furthermore, the stator has, in the interior of at least one blade 5, at least one flow path connecting the at least one primary peripheral chamber 13 at the load-transmitting fixed blade end with at least one secondary peripheral chamber 14 defined by its position outside of the main flow path at the other fixed blade end of the stator, with fluid also being issued from the at least one secondary peripheral chamber 14 through at least one outlet 6 onto the surface of the main flow path confinement.

According to the present invention, a favorable condition exists if, in accordance with the representation in FIG. 3*b*, the fixed blade end with secondary peripheral chamber 14 is a load-free fixed blade end and the at least one secondary peripheral chamber 14 is provided within the shroud 10.

Furthermore, as shown in FIG. 3*b*, it is particularly advantageous according to the present invention if, originating on at least one flow path in the interior of at least one blade 5, at least one outlet 15 to at least one of the two blade surfaces (convex suction side SS, concave pressure side PS (DS)) is provided through which fluid is additionally enabled to issue, in which case it is further advantageous if, with several outlets 15 being provided on blade surfaces, at least three slot-type outlets 15 are essentially in main flow-transverse direction arranged side by side and in one row on the suction side.

FIG. 3*c* shows the example of a blade row according to the present invention, here a rotor with load-transmitting fixed blade end at the hub. At the casing 1, a free blade end with running gap is provided.

The blade 5, being flown from the left to the right, is shown in meridional section in the left-hand part of the figure and in View Y-Y (hub view) in the right-hand part of the figure.

The rotor has, at its load-transmitting fixed blade end, at least one fluid-supplied primary peripheral chamber 13 disposed outside of the main flow path and outlined in the illustration in only simplified form, from which fluid issues onto the surface of the main flow path confinement through at least one outlet 6.

FIG. 3*d* shows the example of a blade 5 according to the present invention, here a rotor with load-transmitting fixed blade end at the hub 3 and load-free fixed blade end (with shroud 10) at the casing 1. Shroud 10 and casing 1 perform a rotary movement relative to each other, with sealing being provided by sealing fins 11 in a cavity 12 surrounding the shroud 10. The blade 5, being flown from the left to the right, is shown in meridional section in the left-hand part of the figure and in View X-X (casing view) in the right-hand part of the figure.

The rotor has, at its load-transmitting fixed blade end, at least one fluid-supplied primary peripheral chamber 13 disposed outside of the main flow path, from which fluid issues onto the surface of the main flow path confinement through one outlet 6.

Furthermore, the rotor has, in the interior of at least one blade 5, at least one flow path connecting the at least one primary peripheral chamber 13 at the load-transmitting fixed blade end with at least one secondary peripheral chamber 14 defined by its position outside of the main flow path at the other fixed blade end of the rotor, with fluid also being issued from the at least one secondary peripheral chamber 14 through at least one outlet 6 onto the surface of the main flow path confinement.

According to the present invention, a favorable condition exists if, in accordance with the representation in FIG. 3*d*, the fixed blade end with secondary peripheral chamber 14 is a load-free fixed blade end and the at least one secondary peripheral chamber 14 is provided within the shroud 10.

Furthermore, as shown in FIG. 3*d*, it is particularly advantageous according to the present invention if, originating on at least one flow path in the interior of at least one blade 5, at least one outlet 15 to at least one of the two blade surfaces (convex suction side SS, concave pressure side PS (DS)) is provided through which fluid is additionally enabled to issue, in which case it is further advantageous if, with several outlets 15 being provided on blade surfaces, at least three slot-type outlets are essentially in main flow-transverse direction arranged side by side and in one row on the suction side.

The opening of at least one outlet 6 on the main flow path confinement of the respective blade row is, in accordance with the present invention, provided in the environment of the suction side.

In the representation in FIGS. 3*a*, 3*b*, 3*c* and 3*d*, each blade 5 has only one outlet 6 opening per blade passage. However, other than in this representation, also several outlet 6 openings can, according to the present invention, be provided in each blade passage.

According to the present invention, the outlet 6 has an ideally nozzle-type shape inclined in the main flow direction, with the fluid jet exiting from the outlet 6 through the outlet opening being impressed a major component parallel to the main flow, thereby attaching essentially tangentially onto the main flow path confinement.

According to the present invention, the peripheral contour can be smooth in the area of the outlet opening or have a local, setback-type step relative to the main flow direction.

FIG. 4*a* shows on both its left and right-hand side the blade row according to the present invention with fixed blade end in a developed flow line section in the vicinity of the main flow path confinement, approximately corresponding to View X-X or Y-Y, i.e. in the plane established by the meridional flow direction m and the circumferential direction u. For clarity, only two profile sections of the blade row 5 according to the present invention have been shown. As indicated by the bold arrow, flow is obliquely from the left to the right. Each profile has a skeleton line SL which for the purpose of the present invention is being given, within the profile, by the centerline between pressure and suction side and, outside of the profile, by the respective tangential extension of this centerline at leading and trailing edge.

In the left-hand part of the figure, W designates the width of the blade passage at the throat between two adjacent blade profiles at the main flow path confinement. The thickness of the profile at the throat is marked d.

Besides the skeleton lines SL of the two profiles shown, a limiting line LL (GL) is drawn which, in accordance with the present invention, extends through the passage formed between two blade profiles, having a constant distance $a=W+0.5\cdot d$ to the convex side of the skeleton line. This limiting line restricts the area of sensible positions of outlet openings according to the present invention. Therefore, in accordance with the present invention, outlet openings are always arranged upstream of the trailing edge line TEL (HKL) in the area between the convex side of a skeleton line SL and the concave side of the limiting line LL (GL) which is next in the direction of the pressure side of the adjacent profile.

The left-hand side of the figure shows examples according to the present invention of slot-type outlet openings disposed approximately transversely to the main flow within the area between skeleton line SL and limiting line LL (GL). A small arrow indicates the exiting fluid jet each.

According to the present invention, it is favorable to position an outlet 6 opening directly at the profile suction side SS (see center opening) or also at the periphery RF of the rounding radius normally provided on the blade ends and also termed fillet radius (see rearward opening). When arranged upstream of the leading edge line LEL (VKL), proximity to the skeleton line is favorable (see forward opening).

Through each of the outlet 6 openings shown, the respective centerline passes transversely or obliquely to the main flow and to the jet exit direction. In the case of a single opening, as shown in this example, the centerline of the opening is defined as the so-called exit trajectory TJ.

The right-hand side of the figure shows examples according to the present invention of rows of outlet openings disposed approximately obliquely to the main flow. A small arrow indicates the exiting fluid jet each. The individual openings can have angular or round/oval shape and be regularly or irregularly spaced from each other.

In the case of a row of openings disposed transversely or obliquely to the main flow and to the jet exit direction, as shown in this example, the connecting line of the centroids of the openings appertaining to the row is defined as exit trajectory TJ.

According to the present invention, it is favorable if the exit trajectory, throughout its course, is oriented essentially orthogonally to the local tangent to the skeleton line.

FIG. 4*b* shows on the left-hand side a passage between two adjacent profiles at the main flow path confinement. In the passage, a typical set of isobars (lines of constant static pressure) is drawn with broken lines. As is apparent, the isobars are over a wide range inclined in the upstream direction and uniformly curved. For functional reasons, it is therefore particularly favorable according to the present invention if, in correspondence with the course of the isobars, an outlet trajectory is inclined in the upstream direction and uniformly curved. For clarification, one isobar has been solidly drawn.

In the right-hand part of the figure, the solidly drawn isobar is again shown. This isobar is partly congruent with the trajectory TJ of the outlet opening also shown.

Furthermore, it can be particularly favorable according to the present invention to arrange outlet openings even closer to the suction side of the profile, restricted by the limiting line LL (GL) situated at a smaller, constant distance $a=0.7\cdot W+0.5\cdot d$ to the convex side of the skeleton line.

FIG. 4*c* shows, according to the present invention, the particularly favorable position of the outlet traverse upstream of the line LW extending in the throat between two adjacent profiles.

FIG. 4*d* clarifies the definition of the inclination of an outlet trajectory according to the present invention. For orientation, a blade profile and an outlet opening are shown dotted in the background.

The trajectory extends between the start point TA and the end point TE. Crucial according to the present invention is the angular range within which the inclination angle $\alpha$ is kept which is locally included by the trajectory TJ along its course and by the skeleton line. For determining the inclination angle $\alpha$ in a specific point T of the trajectory TJ, the perpendicular is firstly to be erected on the skeleton line SL in the direction of the suction side of the nearest profile. This establishes the vertical point C. Finally, as conveyed in the figure, the inclination angle $\alpha$ is included between the tangent to the trajectory in the point T under consideration and the tangent to the skeleton line in the vertical point C.

Applicable to all outlet trajectories according to the present invention, the inclination angle $\alpha$ along the entire trajectory according to this definition has values in the range $0°<\alpha<100°$.

Viewing the outlet in enlarged representation in the Section Z-Z shown in FIG. 4*b*, the course of the outlet and the type of the transition from the outlet to the surface of the main flow path confinement can have different characteristics according to the present invention.

In accordance with FIG. 5*a*, the simplest form of an outlet 6 according to the present invention is an oblique entrance into the surface of the main flow path confinement, with a bend at the entrance location (bending point G) and with smooth course of the contour of the main flow path confinement. The entrance angle β is measured at the bending point G between the tangent to the inner contour of the outlet and the tangent to the contour of the main flow path confinement and shall, according to the present invention, be less than 25° (β<25°).

FIG. 5*b* shows in Section Z-Z a nozzle-type course of the outlet inclined in the main flow direction and curved, here with a step in the contour of the main flow path confinement at the entrance location. According to the present invention, the features of this outlet are described using two inscribed circles and the centerline of the outlet in the one plane here viewed. Firstly, approaching from outside of the blade, the throat of the outlet is established. The throat has the width e, but need not be situated directly at the opening of the outlet as shown here. The center of the circle established in the throat is marked ME. Proceeding further inwards into the outlet, further, continuously increasing circles can be inscribed to establish the centerline GML of the outlet. Along the centerline GML, the effective length k of the outlet is measured which, further inwardly in the blade, is limited by the center MI of a final inscribed circle.

FIG. 5*c* shows in Section Z-Z further features of the outlet according to the present invention with regard to its transition into the surface of the main flow path confinement. As already shown in FIG. 5*b*, the throat of the outlet 6 has the width e. The point of contact of the circle inscribed in the throat with the inner, here convex confining contour of the outlet 6 is marked P. The tangent TGA and the tangent TGO here serve to describe the transition of the outlet 6 into the surface of the blade. TGA is the tangent in point P to the inner outlet confining contour. TGO is established as tangent to a circle (not shown in the figure) through the blade surface points X, Y and Z. Point X is established as point of intersection of an orthogonal on TGA being tangential to the circle in the throat. Point Y lies at a distance of two throat widths (2*e*) upstream of point X measured along the blade outer contour. Point Z lies at a distance of two throat widths (2*e*) upstream of point Y measured along the blade outer contour.

Of preferential importance is the step height f which is measured as orthogonal distance of point Q to tangent TGO. Point Q lies two throat widths (2*e*) downstream of point P.

Finally, in accordance with the present invention, the following provisions preferably apply for the configuration of the outlet:

a.) the throat of the outlet is at or near the outlet opening, b.) the outlet has, from the throat towards the blade interior, a cross-sectional width which continuously increases over the entire effective length k (nozzle-type shape between the beginning and the end circle centers MI and ME), c.) the effective length k, relative to the throat width e, lies in the value range k/e >0.7, d.) the entrance angle γ included by the tangents TGO and TGA lies in the value range 0°<γ<60°, e.) the step height f, relative to the throat width e, lies in the value range 0<f/e<3.

FIG. 5*d* shows an outlet 6 with additional configurational elements. In a particular embodiment according to the present invention, at least one partition 9 can be provided in the area of the outlet 6 or also in the area of the cavity which divides or, similar to a blade cascade, also deflects the fluid flow supplied before the latter issues as tangential jet onto the blade surface.

The present invention can be described as follows:

A fluid flow machine has a main flow path in which at least one row of blades is arranged, with at least one blade end of a blade row being firmly connected to the main flow path confinement and at least one fluid-supplied peripheral chamber being arranged in the area of this blade end outside of the main flow path confinement, with at least one outlet being arranged in the area of said fixed blade end in the vicinity of at least one blade suction side through which fluid is issued from the said at least one peripheral chamber in an aerodynamically favorable way onto the surface of the main flow path confinement into the main flow path, with a.) the fluid jet, produced by virtue of the shape and orientation of the said at least one outlet, being oriented, immediately upon its entry into the main flow path, essentially tangentially to the contour of the main flow path confinement when viewed in the meridional plane (x-r plane) and essentially parallelly to the local tangent to the skeleton line of the nearest profile, and thus approximately in the direction of the main flow on said blade end, when viewed in the plane established by the circumferential direction u and the meridional direction m, b.) the opening of the at least one outlet being provided on the main flow path confinement in the plane established by the circumferential direction u and the meridional direction m upstream of the trailing edge line between the convex side of the skeleton line of the nearest profile and a limiting line, with the skeleton line here being formed by the centerline of the profile and its tangential extensions at leading and trailing edge, and with the limiting line passing through the passage formed between two blade profiles at a constant distance a=W+0.5·d to the convex side of the skeleton line, with W being the width of the blade passage at the throat and d being the thickness of the profile at this throat, c.) the extension and course of a single outlet opening provided on the main flow path confinement being characterized by an outlet trajectory, with the outlet trajectory being formed by the transversing centerline of the outlet opening (transversely and/or obliquely to the main flow direction), d.) the extension and course of a row of outlet openings provided side by side on the main flow path confinement being characterized by an outlet trajectory, with the outlet trajectory being formed by the connecting line through the centers of the rowed outlet openings, e.) at least one outlet trajectory having, throughout its course, values of the relative inclination angle α in the range 0°<α<100°, with the relative inclination angle α being measured between the local tangent to the outlet trajectory in a point T and the local tangent to the skeleton line in the root point of the perpendicular from T on the skeleton line, with preferably the opening of the at least one outlet being provided on the main flow path confinement in the plane established by the circumferential direction u and the meridional direction m upstream of the trailing edge line between the convex side of the skeleton line of the nearest profile and a limiting line, with the limiting line passing through the passage formed between two blade profiles at a constant distance a=0.7*W+0.5*d to the convex side of the skeleton line, with preferably the opening of the at least one outlet being provided on the main flow path confinement in the plane established by the circumferential direction u and the meridional direction m upstream of the throat of the passage formed between two adjacent profiles, with preferably the outlet trajectory, throughout its course, being essentially orthogonally oriented to the local tangent to the skeleton line, with preferably the outlet trajectory being upstreamly inclined and uniformly curved in correspondence with the course of the isobars at the main flow path confinement, with preferably at least one outlet opening immediately adjoining the profile suction side, with preferably at least one outlet opening immediately adjoining the periphery of the rounding radius of the blade end, with preferably at least one outlet opening being provided upstream of the leading edge line in immediate vicinity of the skeleton line, with preferably in the area of the outlet or also in the area of the peripheral chamber at least one partition being provided which divides or, similar to a blade cascade, also deflects the fluid flow supplied before the latter issues onto the main flow path confinement, with preferably the fixed blade end of the blade row being a load-transmitting fixed blade end, so that the fixed blade end and the physical structure surrounding the blade end do not perform a rotary movement relative to each other, with preferably at least one peripheral chamber being provided on the load-transmitting fixed blade end as primary peripheral chamber from which additionally at least one flow path leads into the interior of at least one blade, with preferably the blade row on the opposite side of the main flow path also having a fixed blade end and at least one secondary peripheral chamber being provided there outside of the main flow path confinement, with the at least one secondary peripheral chamber connecting to the primary peripheral chamber via the at least one flow path in the interior of at least one blade, and with fluid issuing from the at least one secondary peripheral chamber through at least one outlet onto the surface of the main flow path confinement, with preferably the blade end provided on the opposite side of the main flow path being a load-free blade end and, accordingly, the fixed blade end having a shroud surrounded by a cavity, with the shroud and the physical structure surrounding the shroud performing a rotary relative movement and the secondary peripheral chamber being provided within the shroud, with preferably, originating on at least one flow path in the interior of at least one blade, additionally at least one outlet through which fluid issues into the main flow path being provided to at least one of the two blade surfaces (convex suction side and concave pressure side), with preferably—where several outlets on blade surfaces are provided—at least three slot-type outlets essentially in main-flow transverse direction being arranged side by side and in a row at the suction side, with preferably the at least one outlet obliquely entering the surface of the main flow path confinement and a bend to the contour of the main flow path confinement being provided at the entrance location, with the entrance angle β, measured at the bending point between the tangent to the inner contour of the outlet and the tangent to the contour of the main flow path confinement having values smaller than 25°, with preferably one outlet being of nozzle-type shape, with preferably the contour of the main flow path confinement in the area of an outlet opening being smooth, with preferably the contour of the main flow path confinement in the area of an outlet opening having a local, setback-type step relative to the main flow direction, with preferably the form of at least one outlet on a main flow path confinement at a fixed blade end being defined as follows:

a.) the throat of the outlet is at or near the outlet opening, b.) the outlet has, from the throat towards the wall of the main flow path confinement, a cross-sectional width which continuously increases over the entire effective length k, as well as a uniformly signed curvature between the beginning and the end circle centers MI and ME, c.) the effective length k, relative to the throat width e, lies in the value range $k/e>0.7$, d.) the entrance angle γ included by the tangents TGO and TGA lies in the value range $0°<\gamma<60°$, e.) the step height f, relative to the throat width e, lies in the value range $0<f/e<3$.

Various aspects of the various embodiments disclosed above can be combined in different combinations to create alternative embodiments within the scope of the invention.

The present invention provides for a significantly higher aerodynamic loadability of rotors and stators in fluid flow machines, with efficiency being maintained or even improved. A reduction of the number of parts and the weight of the components by more than 20 percent seems to be achievable. Application of the concept to the high-pressure compressor of an aircraft engine with approx. 25,000 lbs thrust leads to a reduction of the specific fuel consumption of up to 0.5 percent.

LIST OF REFERENCE NUMERALS

1 Casing
2 Annulus duct/main flow path
3 Rotor drum (hub)
4 Machine axis
5 Blade/blade row
6 Outlet
7 Peripheral chamber
8 Tangential jet
9 Partition/deflection chamber
10 Shroud
11 Sealing fin
12 Cavity
13 Primary peripheral chamber
14 Secondary peripheral chamber
15 Outlet

What is claimed is:

1. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent and separated from at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0°<\alpha<100°$, with the relative inclination angle $\alpha$ being measured between a local tangent to the outlet trajectory in a point T and a local tangent to the skeleton line in a root point of a perpendicular from T on the skeleton line;

wherein the opening of the at least one outlet is provided on the main flow path confinement in the plane established by the circumferential direction u and the meridional direction m upstream of a throat of the passage formed between two adjacent profiles of blades; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

2. The fluid flow machine of claim 1, wherein the constant distance (a) of the limiting line is no greater than 0.7W+0.5d to the convex side of the skeleton line.

3. The fluid flow machine of claim 1, wherein the outlet trajectory, throughout its course, is essentially orthogonally oriented to the local tangent to the skeleton line.

4. The fluid flow machine of claim 1, wherein the outlet trajectory is upstreamly inclined and uniformly curved in correspondence with a course of an isobar line of constant static pressure existing between adjacent blades at the main flow path confinement.

5. The fluid flow machine of claim 1, wherein at least one outlet opening immediately adjoins a profile suction side.

6. The fluid flow machine of claim 1, wherein at least one outlet opening immediately adjoins a periphery of a rounding radius of the blade end.

7. The fluid flow machine of claim 1, wherein at least one outlet opening is provided upstream of a leading edge line in an immediate vicinity of the skeleton line.

8. The fluid flow machine of claim 1, wherein, in at least one of an area of the outlet and an area of the peripheral chamber, at least one partition is provided which at least one of divides and deflects fluid flow supplied before it issues onto the main flow path confinement.

9. The fluid flow machine of claim 1, wherein the fixed blade end of the blade row is a load-transmitting fixed blade end, and the fixed blade end and a physical structure surrounding the blade end are rotationally stationary relative to each other.

10. The fluid flow machine of claim 9, wherein the at least one peripheral chamber is provided on the load-transmitting fixed blade end as a primary peripheral chamber from which additionally at least one flow path leads into an interior of an airfoil portion of at least one blade.

11. The fluid flow machine of claim 10, wherein a blade row on an opposite side of the main flow path has a fixed blade end and at least one secondary peripheral chamber is provided outside of the main flow path confinement, with the at least one secondary peripheral chamber connecting to the primary peripheral chamber via the at least one flow path in the interior of at least one blade, and with fluid issuing from the at least one secondary peripheral chamber through at least one outlet onto the surface of the main flow path confinement.

12. The fluid flow machine of claim 11, wherein the blade end provided on the opposite side of the main flow path is a load-free blade end and, accordingly, the fixed blade end has a shroud surrounded by a cavity, with the shroud and physical structure surrounding the shroud performing a rotary relative movement and the secondary peripheral chamber being provided within the shroud.

13. The fluid flow machine of claim 12, wherein, originating on at least one flow path in the interior of at least one blade, additionally at least one outlet through which fluid issues into the main flow path is provided to at least one of the convex suction side and concave pressure side blade surfaces.

14. The fluid flow machine of claim 13, wherein, where several outlets on blade surfaces are provided, at least three slot-type outlets essentially in main-flow transverse direction are arranged side by side and in a row at the suction side.

15. The fluid flow machine of claim 1, wherein the at least one outlet obliquely enters the surface of the main flow path confinement and a bend to a contour of the main flow path confinement is provided at the entrance location, with an entrance angle $\beta$, measured at the bending point between a tangent to an inner contour of the outlet and a tangent to the contour of the main flow path confinement having values smaller than 25°.

16. The fluid flow machine of claim 15, wherein the at least one outlet is of nozzle-type shape.

17. The fluid flow machine of claim 15, wherein the contour of the main flow path confinement in the area of an outlet opening is smooth.

18. The fluid flow machine of claim 15, wherein the contour of the main flow path confinement in the area of an outlet opening has a local, setback-type step relative to the main flow direction.

19. The fluid flow machine of claim 1, wherein a form of at least one outlet on a main flow path confinement at a fixed blade end is defined as follows:

a) a throat of the outlet is at or near the outlet opening, b) the outlet has, from the throat towards a wall of the main flow path confinement, a cross-sectional width which continuously increases over an entire effective length k, as well as a uniformly signed curvature between beginning and end circle centers MI and ME, c) an effective length k, relative to the throat width e, lies in a value range $k/e>0.7$, d) an entrance angle $\gamma$ included by tangents TGO and TGA lies in a value range $0^\circ<\gamma<60^\circ$, e) a step height f, relative to the throat width e, lies in a value range $0<f/e<3$.

20. The fluid flow machine of claim 1, wherein the at least one outlet arranged in the area of the fixed blade end is arranged on a rotor blade.

21. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent and separated from at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0^\circ<\alpha<100^\circ$, with the relative inclination angle $\alpha$ being measured between a local tangent to the outlet trajectory in a point T and a local tangent to the skeleton line in a root point of a perpendicular from T on the skeleton line;

wherein the outlet trajectory is upstreamly inclined and uniformly curved in correspondence with a course of isobars at the main flow path confinement; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

22. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0°<\alpha<100°$, with the relative inclination angle $\alpha$ being measured between a local tangent to the outlet trajectory in a point T and a local tangent to the skeleton line in a root point of a perpendicular from T on the skeleton line;

wherein at least one outlet opening immediately adjoins a profile suction side; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

23. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent and separated from at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0°<\alpha<100°$, with the relative inclination angle $\alpha$ being measured between a local tangent to the outlet trajectory in a point T and a local tangent to the skeleton line in a root point of a perpendicular from T on the skeleton line;

wherein at least one outlet opening immediately adjoins a periphery of a rounding radius of the blade end; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

24. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent and separated from at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0°<\alpha<100°$, with the relative inclination angle $\alpha$ being measured between a local tangent to the outlet trajectory in a point T and a local tangent to the skeleton line in a root point of a perpendicular from T on the skeleton line;

wherein the at least one peripheral chamber is provided on a load-transmitting fixed blade end as a primary peripheral chamber from which additionally at least one flow path leads into an interior of an airfoil portion of at least one blade; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

25. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent and separated from at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0°<\alpha<100°$, with the relative inclination angle $\alpha$ being measured between a local tangent to the outlet trajectory in a point T and a local tangent to the skeleton line in a root point of a perpendicular from T on the skeleton line;

wherein a blade row on an opposite side of the main flow path has a fixed blade end and at least one secondary peripheral chamber is provided outside of the main flow path confinement, with the at least one secondary peripheral chamber connecting to the primary peripheral chamber via at least one flow path in the interior of at least one blade, and with fluid issuing from the at least one secondary peripheral chamber through at least one outlet onto the surface of the main flow path confinement; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

26. A fluid flow machine, comprising:

a main flow path;

at least one row of blades positioned in the main flow path in a portion of the fluid flow machine imparting energy to a working medium;

at least one blade end of the blade row being firmly fixed to the main flow path confinement;

at least one fluid-supplied peripheral chamber being arranged in an area of the fixed blade end outside of the main flow path confinement;

at least one outlet being arranged in the main flow path confinement in the area of the fixed blade end adjacent and separated from at least one blade suction side through which fluid can be issued from the at least one peripheral chamber onto a surface of the main flow path confinement into the main flow path, wherein:

a) the fluid jet, produced by virtue of a shape and orientation of the at least one outlet is oriented, immediately upon its entry into the main flow path, essentially tangentially to a contour of the main flow path confinement when viewed in a meridional plane (x-r plane) and essentially parallel to a local tangent to a skeleton line of a nearest profile of a blade and essentially in the direction of the main flow on the blade end, when viewed in a plane established by a circumferential direction u and a meridional direction m, b) an opening of the at least one outlet is provided on the main flow path confinement in the plane established by the circumferential direction u and the meridional direction m upstream of a trailing edge line between a convex side of the skeleton line of the nearest profile of a blade and a limiting line, with the skeleton line being formed by a centerline of a profile of the blade and tangential extensions at leading and trailing edges, the opening positioned between the at least one blade suction side and the limiting line passing through a passage formed between two blade profiles, the limiting line positioned at a constant distance (a) to a convex side of the skeleton line, where (a) is no greater than W+0.5d, with W being a width of the blade passage at the throat and d being a thickness of the profile of the blade at this throat, c) wherein, when the opening of the at least one outlet is a single outlet opening on a line normal to a skeleton line of the blade is provided on the main flow path confinement on the suction side of the blade, an extension and course of the single outlet opening has an outlet trajectory, with the outlet trajectory being formed by a transversing centerline of the outlet opening, d) wherein, when the opening of the at least one outlet is a row of side by side outlet openings extending along the line normal to the skeleton line of the blade is provided on the main flow path confinement on the suction side of the blade, an extension and course of the row of side by side outlet openings has an outlet trajectory, with the outlet trajectory being formed by a connecting line through centers of the row of side by side outlet openings, e) at least one outlet trajectory has, throughout its course, values of a relative inclination angle $\alpha$ in a range $0° < \alpha < 100°$, with the relative inclination angle $\alpha$ being measured between a local tangent to the outlet trajectory in a point T and a local tangent to the skeleton line in a root point of a perpendicular from T on the skeleton line;

wherein the at least one outlet arranged in the area of the fixed blade end is arranged on a rotor blade; and wherein the opening of the at least one outlet has at least one dimension that is greater than a thickness of a leading edge of the blade, wherein the at least one dimension is a cross-sectional dimension of the single outlet opening when the opening of the at least one outlet is the single outlet opening and the at least one dimension is a sum of like cross-sectional dimensions of the row of side by side outlet openings when the opening of the at least one outlet is the row of side by side outlet openings.

* * * * *